US007926559B2

(12) United States Patent
Salloum

(10) Patent No.: US 7,926,559 B2
(45) Date of Patent: Apr. 19, 2011

(54) OILFIELD STUFFING BOX

(75) Inventor: Eduardo Salloum, Maracaibo (VE)

(73) Assignee: Robbins & Myers Energy Systems L.P., Willis, TX (US)

( * ) Notice: Subject to any disclaimer, the term of this patent is extended or adjusted under 35 U.S.C. 154(b) by 74 days.

(21) Appl. No.: 12/413,952

(22) Filed: Mar. 30, 2009

(65) Prior Publication Data

US 2010/0243233 A1 Sep. 30, 2010

(51) Int. Cl.
*E21B 33/04* (2006.01)

(52) U.S. Cl. ..... 166/78.1; 166/84.1; 166/84.3; 166/84.4

(58) Field of Classification Search ..... 166/68.5, 166/78.1, 84.1, 84.3, 84.4
See application file for complete search history.

(56) References Cited

U.S. PATENT DOCUMENTS

| | | | | |
|---|---|---|---|---|
| 5,217,068 | A * | 6/1993 | Newton | 166/84.2 |
| 5,823,541 | A | 10/1998 | Dietle et al. | |
| 6,843,313 | B2 | 1/2005 | Hult | |
| 7,044,217 | B2 | 5/2006 | Hult | |
| 2005/0045323 | A1 * | 3/2005 | Hult | 166/68.5 |

FOREIGN PATENT DOCUMENTS

| | | |
|---|---|---|
| CA | 2095937 | 12/1998 |

* cited by examiner

*Primary Examiner* — William P Neuder
(74) *Attorney, Agent, or Firm* — Browning Bushman P.C.

(57) ABSTRACT

A stuffing box (10) is provided for sealing with a rotating rod string (20) extending into a well for powering a pump (22). A sleeve (30) is rotated within the stuffing box housing (24) and receives the sucker rod therein, while one or more bearings (34, 36) guide rotation of the sleeve. A plurality of static seals (50) seal between the sleeve and the sucker rod, while a plurality of dynamic seals (40) seal between the sleeve and the stuffing box housing.

17 Claims, 4 Drawing Sheets

OILFIELD STUFFING BOX

FIELD OF THE INVENTION

The present invention relates to stuffing boxes of the type used to seal with a rotating rod string extending into a well for powering a downhole pump. More particularly, this invention relates to a "leakless" stuffing box which offers a low risk of well fluid leaking past the seals in the stuffing box, and optionally a mechanism to capture any leakage that may occur.

BACKGROUND OF THE INVENTION

Various types of stuffing boxes are commercially available for placing on a wellhead to seal with the rod string to power a downhole pump. In some applications, the rod string is reciprocated in the well to power the downhole pump, and the stuffing box is designed to seal with the rod string while accommodating that reciprocation. In other applications, such as those involving a progressive cavity pump, the rod is rotated in the well, and the stuffing box then is intended to seal with the rotating rod string which powers the downhole pump, and most importantly does not wear or otherwise damage the rod string, which may lead to failure.

U.S. Pat. No. 5,823,541 discloses a rod seal cartridge for a progressive cavity pump with a single o-ring seal between the rod and the sleeve. U.S. Pat. No. 6,843,313 discloses a stuffing box with fluid pressure energized static seals between the rod and the sleeve, and packings between the housing and the sleeve to provide a dynamic seal. U.S. Pat. No. 7,044,217 discloses a similar arrangement, with a coil spring acting on the dynamic seals. Canadian Patent 2,095,937 also discloses static seals between the rod string and an extension of a sleeve, with seal cartridges between the sleeve and the housing.

The disadvantage of the prior art is overcome by the present invention, an improved stuffing box and method of sealing with the rod string are hereinafter disclosed.

SUMMARY OF THE INVENTION

In one embodiment, a stuffing box is provided for sealing with a rotating rod string extending into a well for powering a downhole pump. A stuffing box housing has a lower open end and an upper open end each for receiving the rod string therein. A sleeve is rotatable within the stuffing box housing and has an elongate cavity therein for receiving a portion of the rod string. One or more bearings guide rotation of the sleeve with respect to the stuffing box housing. A plurality of static seals each seal between the sleeve and the rod string, while a plurality of dynamic seals seal between the sleeve and the stuffing box housing. In one embodiment, a connector is provided for rotatable interconnecting the drive shaft and the sleeve, thus allowing for the disassembly of the drive shaft from the sleeve while the sleeve remains within the housing. The sleeve includes a top cap portion axially movable with respect to a lower sleeve portion. A compressing member activated by movement of the top cap with respect to the lower sleeve portion compresses each of the plurality of static seals for static sealing engagement with the rod string. The stuffing box as disclosed herein may include a lower flange for mating with an upper flange on a wellhead, and may include an upper flange for mating with a lower flange on a drivehead.

These and further features and advantages of the present invention will become apparent from the following detailed description, wherein reference is made to the figures in the accompanying drawings.

DETAILED DESCRIPTION OF PREFERRED EMBODIMENTS

Figure 1:
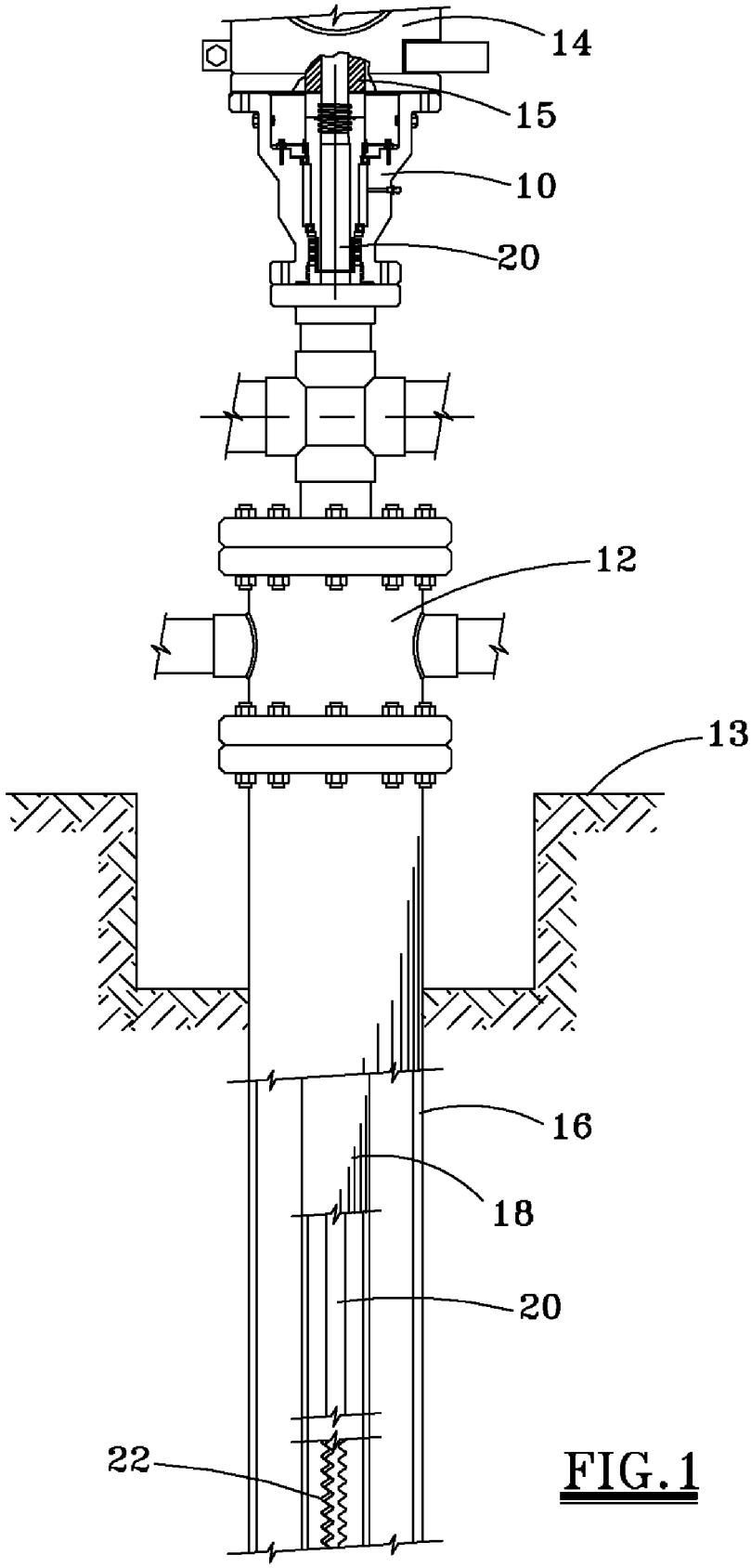
FIG. 1 is a simplified pictorial view of a rotary drivehead above the stuffing box which is above a wellhead, with a production tubing string and a rod string extending downhole in a well to power a downhole pump.

FIG. 1 generally depicts the position of a stuffing box 10 in an oil well installation, which includes a rotary drive 14 for transmitting torque from drive shaft 15 to rod 20, which extends axially through the wellhead 12 and into the stuffing box 10. The wellhead is provided at the surface 13, with the well including at least one casing 16 extending down into the well, a production tubing 18 within the casing 16, and rod string 20 within the production tubing string. The rod string 20 powers a progressive cavity pump 22, which is typically positioned in the well generally below the fluid producing formation. Rotary drive 14 thus powers the rod 20, which in turn powers the pump 22 to pump fluid to the surface in the annulus between the tubing 18 and the rod 20. The stuffing box seals fluid pressure in the well by effectively sealing with the rotating rod 20, while the rotary drive 14 is conventionally hydraulically or electrically powered to rotate the rod string 20.

Figure 2:
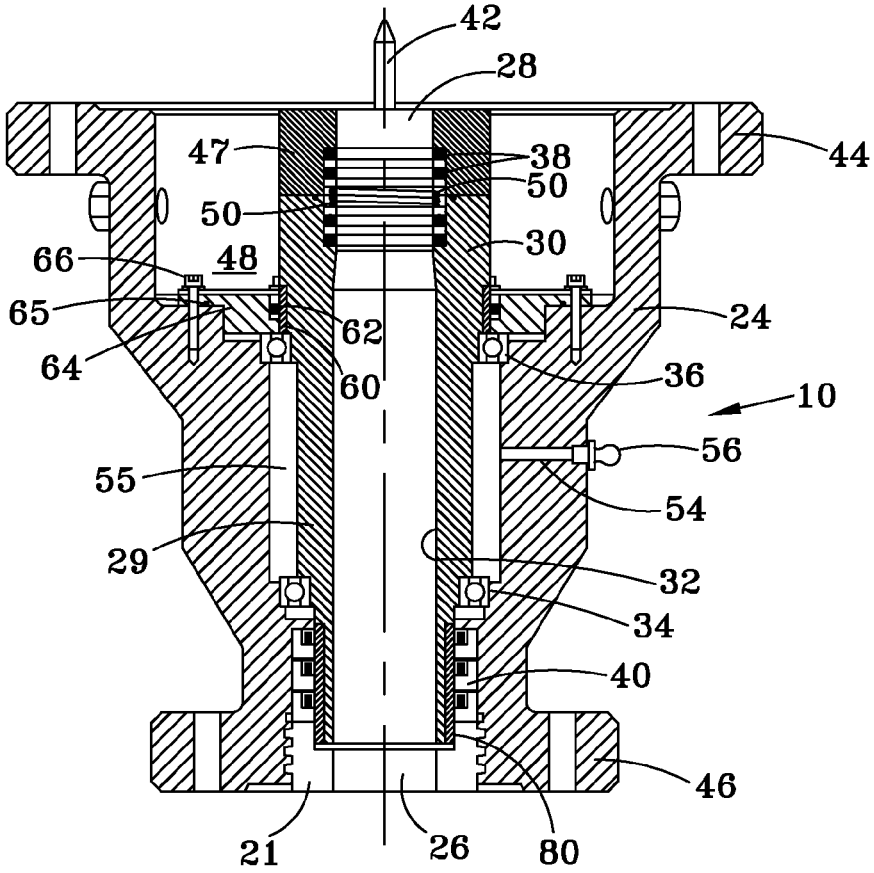
FIG. 2 is a cross-sectional view of the stuffing box generally shown in FIG. 1.

Referring now to FIG. 2, stuffing box 10 is shown in greater detail to include housing 24 having an upper flange 44 for receiving the rod string therein, with the flange 44 adapted for fluid tight connection to a lower flange on the rotary drive 14. The housing 24 also includes a lower flange 46 which is adapted for sealed connection to other surface equipment, such as the upper flange of wellhead 12. Those skilled in the art appreciate that the lower port 26 in the lower coupling 21 may receive the rod 20 therein, or may receive a short rod integral with or connected to a lower portion of the rod string 20. The upper port 28 in the housing 24 may receive the upper end of the rod string 20 therein, and this upper end may be directly coupled to the drive shaft 15 rotated by rotary drive 14, as shown in FIG. 1. Each of the upper flange 44 and the lower flange 46 thus has an open end for receiving the rod string 20 therein.

Standpipe or sleeve 30 is rotatably positioned within the interior of the housing 24, which defines a generally cylindrical cavity 32 therein for receiving the rod 20. A plurality of bearings, such as upper bearing 36 and lower bearing 34, may be used to guide rotation of sleeve 30 with respect to the housing 24. A plurality of fluid pressure and spring energized dynamic seals 40 seal between a close tolerance race 80 and the housing 24, while a plurality of static seals 38, such as o-ring seals, seal between the rotating standpipe or sleeve 30 and the rod 20. Sleeve 30 in turn includes an upper portion 47 and a lower portion 29, and both portions are rotated by connector 42 which extends into the rotary drive 14, such that the sleeve 30, the rod 20, and the seals 38 rotate in unison. One or more coil springs 50 may be provided for biasing the 0-rings 38, as explained subsequently.

FIG. 2 also depicts a passageway 54 through the housing 24, and a grease zerk 56 at the forward end of the passageway. Grease may thus be pumped through the zerk 56 and passage 54 into the cavity 55, thereby providing lubricant for the bearings 34, 36. Those skilled in the art recognize that a small amount of fluid in the annulus between the rod 20 and the tubing may bypass the seals 40 and migrate upward past the bearings 34 and 36. Fluid will be contained in the housing 24, however, by the seal mechanism above the bearing 36. A close tolerance race 60 may thus be provided on the exterior of the sleeve 30, with seals 62 sealing between this race and seal support 64, which is secured by a plurality of circumferentially positioned bolts 66 threaded to the housing 24. Seal 65 seals between seal support 64 and housing 24.

Figure 3:
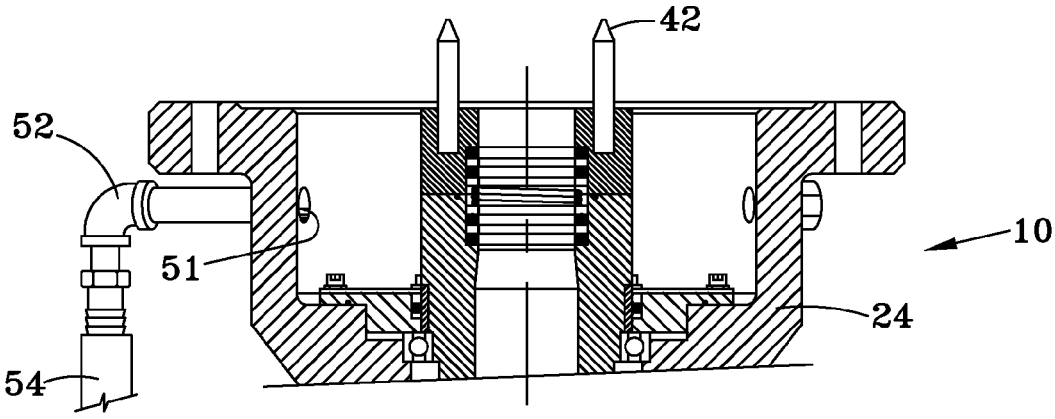
FIG. 3 is another cross-sectional view of the stuffing box shown in FIG. 1.

FIG. 3 depicts a portion of another cross-sectional view of the stuffing box 10 shown in FIG. 1, and more clearly depicts the securing pins 42 which rotatably interconnect the sleeve 30 and the rotary drive 14. FIG. 3 also depicts a port 51 through the housing 24, which communicates with piping 52, which in turn may be connected to a fluid detector 54, which acts as a leak detector to detect when a significant amount of fluid is leaking past the dynamic seals 40 and 62, and the static seal 38. Well fluid which bypasses the dynamic seals 40 and 62, and the static seal 38 may then migrate into cavity 48 and, when accumulated, will flow out port 51 to be detected by sensor 54.

Figure 4:
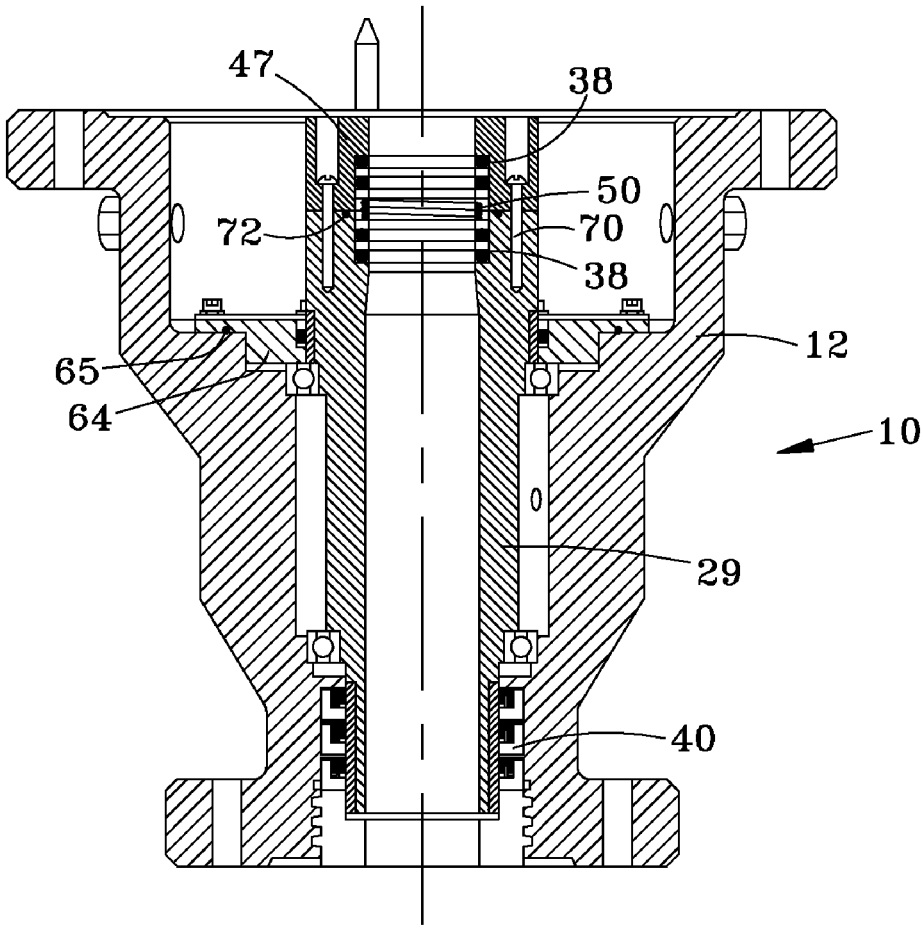
FIG. 4 is another cross-sectional view of the stuffing box, showing in detail a mechanism for activating the static seals.

FIG. 4 depicts yet another cross-section of the stuffing box 10, and specifically illustrates circumferentially positioned bolts 70 which interconnect the top sleeve portion 47 with the lower sleeve portion 29. A plurality of static seals, such as o-ring seals 38, are thus compressed by coil spring 50. Another static seal 72 may seal between the lower portion of 47 and the upper portion of 29, and will inhibit fluid from coming out of the well if fluid bypasses the lower static seals, thereby preventing fluid from leaking between the lower face of the top sleeve portion and the upper face of the lower sleeve portion.

Figure 5:
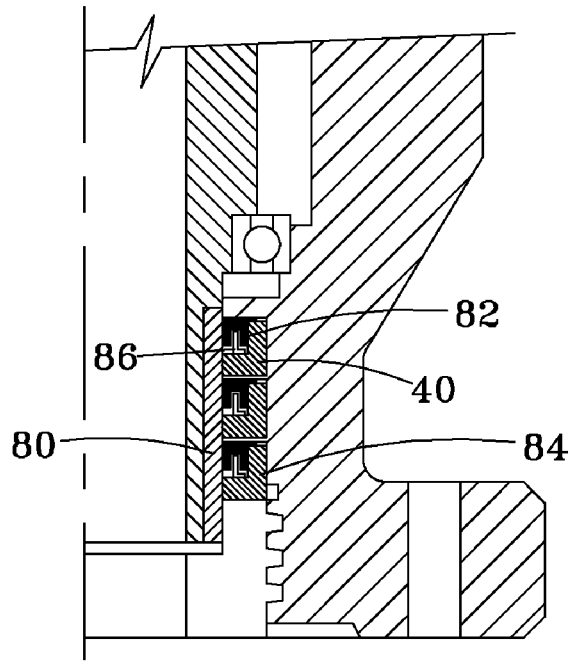
FIG. 5 is an enlarged cross-sectional view of the dynamic seals generally shown in FIG. 2.
Figure 6:
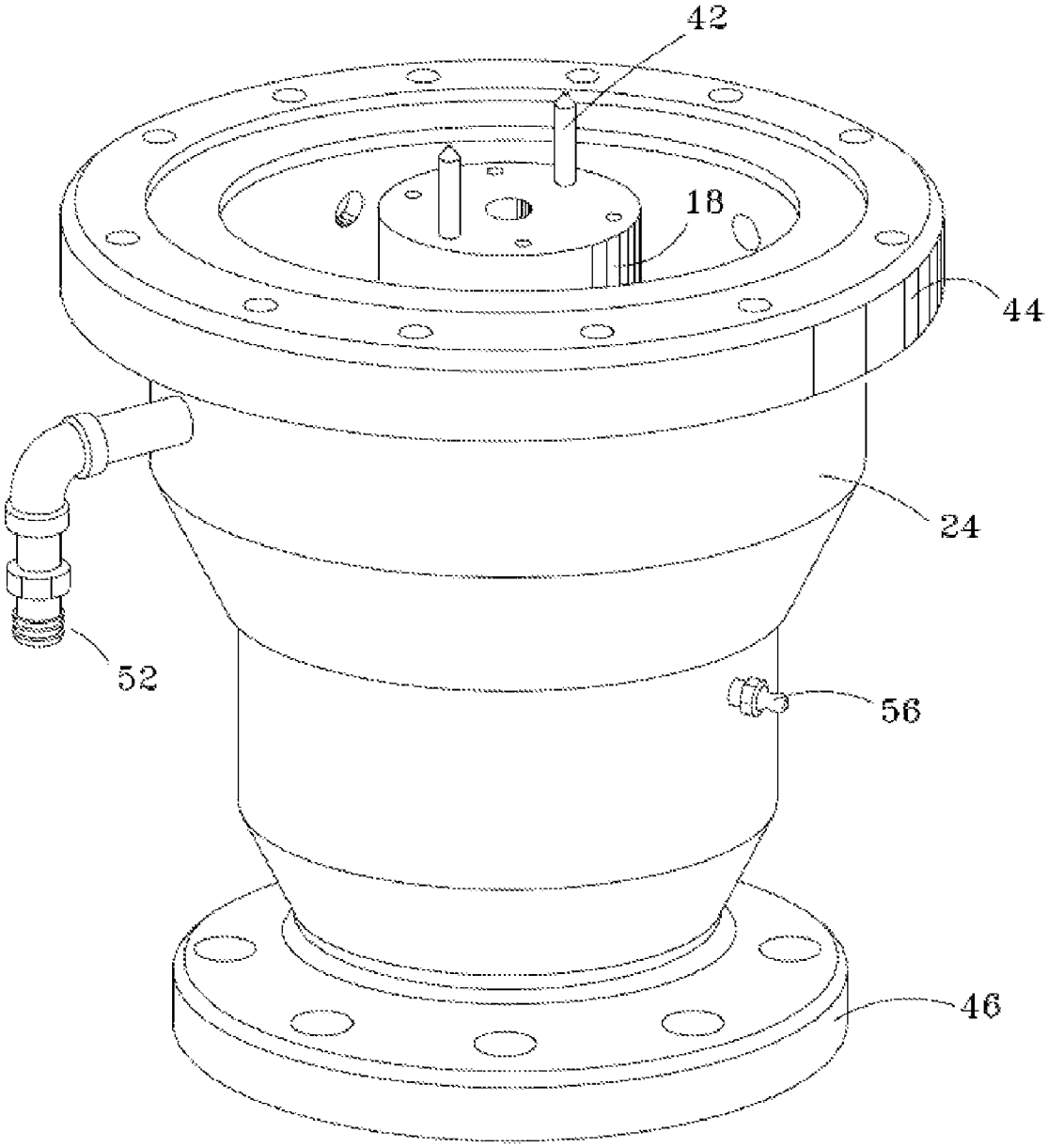
FIG. 6 is a pictorial view of the stuffing box generally shown in FIG. 2.

FIG. 5 depicts an enlarged cross-sectional view of a lower portion of the stuffing box shown in FIG. 1, and more clearly indicates the plurality of fluid pressure and spring energized seals 40. A close tolerance sleeve 80 may be positioned on the lower end of the shaft 30 for reliable sealing engagement with the dynamic seals 40. Each seal 40 may include an L-shaped flange 84, an L-shaped seal support 86, a seal 82. A lip seal sold as a "Flanged Variseal" from Trelleborg is a suitable dynamic seal.

During insulation, the o-ring seals 38 may not touch the rod 20. Once the top cap 47 is bolted to the lower shaft 29, the springs will squeeze the o-ring against the rod 20 with enough axially compressing force to result in a reliable static seal. The properties of the rubber of the o-rings 38 could change with time, particularly when the seal contacts different fluids, or is exposed to variable temperatures. The spring 50 allow the o-rings 38 to accommodate for these changes and maintain a reliable static seal. A graphite coil packing may be used instead of o-ring seals.

Fluid pressure to the dynamic seals 40 is supplied by the well fluid in the annulus surrounding rod 20. The dynamic seals may be designed to reliably seal for some time, even in the absence of fluid pressure below the seals. The dynamic seals may each be spring loaded by an inverted "U" shaped spring fitted between the seal legs to provide a biasing force for reliable sealing with the sleeve 80. The seal member 82 itself is preferably of a lip seal construction, such that fluid pressure acts to enhance sealing engagement. Accordingly, the seal member itself may have an inverted U configuration, as shown in FIG. 5. FIG. 5 also depicts that each lip seal may be provided with L-shaped seal support 86 which keeps the seal member 82 from being adversely effected by grease or other lubricant in the chamber above the seals. Each seal 40 may also be energized by a U-shaped spring, which provides a radial force to bias the seal member into sealing engagement when low pressure is below the dynamic seals. By providing a plurality of fluid energized seals, the longevity of the sealing system is significantly improved, particularly when the fluid produced from the well is not a single-phase fluid. The lower lip seal may thus initially be responsible for stopping the liquid, gas, or solid particles from passing to the second seal, but when the first seal fails, the second seal takes over this function, and so on. If fluid starts leaking from the top chamber 48 in the housing 24, the leaking fluid will be detected by sensor 54, which may include a level control switch. In response to this sensor, the drivehead rotation may be stopped so that the fluid level is lowered before operations continue.

The drivehead shaft, the polish rod 20, and the sleeve 30 rotate in unison, thereby eliminating the possibility of wear on the o-rings. As an alternative to a coil spring, another member may be used to supply the axially compressive force to the static seals. In some embodiments, a wave spring may be used, or a compressive material may be used to supply an axial force to deform the o-rings. The axially compressive force nevertheless provides the effective force directly on the o-rings or on intermediate spacers, such as washers, so that the axial force deforms the o-ring into reliable sealing engagement with both the sleeve 30 and the rod 20. A biasing member is preferred for many applications since access to the compression member to selectively adjust the compressive force over time is difficult.

Thrust bearings in the drivehead may accommodate the axial load upon the rod 20. More particularly, the rod 20 and the shaft of the drivehead are both rotationally and axially coupled, so that a vertical load on the drive shaft is transmitted to the thrust bearings in the drivehead. The drivehead 14 may be hydraulically powered, and in alternative embodiments may be electrically powered.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A stuffing box for sealing with a rotating rod string powered by a drive shaft and extending into a well for powering a pump, comprising:

a stuffing box housing having a lower open end and an upper open end;

a sleeve rotatable within the stuffing box housing and having an elongate cavity for receiving a portion of the rod string, the sleeve including a top cap portion axially movable with respect to a lower sleeve portion;

one or more bearings for guiding rotation of the sleeve with respect to the stuffing box housing;

a plurality of static seals each sealing between the sleeve and the rod string;

an axially compressive member activated by movement of the top cap with respect to the lower sleeve portion to compress each of the plurality of static seals for reliable sealing engagement with the rod string, the compressive member being a coil spring acting between the top cap portion and the lower sleeve portion;

a plurality of dynamic fluid pressure energized seals each sealing between the sleeve and the stuffing box housing;

an outer sleeve supported on the rod string for sealing engagement with the plurality of dynamic seals; and a connector for rotatably interconnecting the drive shaft and the sleeve.

2. A stuffing box as defined in claim 1, wherein the stuffing box housing includes a lower flange for interconnection with a wellhead, and an upper flange for interconnection with a powered drive outputting the drive shaft.

3. A stuffing box as defined in claim 1, wherein the plurality of dynamic seals are energized by well pressure surrounding the rod string.

4. A stuffing box as defined in claim 1, wherein the top cap portion of the sleeve is axially fixed relative to the drive shaft by the connector.

5. A stuffing box as defined in claim 1, further comprising:

another dynamic seal positioned above the one or more bearings for sealing between the housing and the sleeve to retain fluid which may leak past the one or more dynamic seals.

6. A stuffing box as defined in claim 1, further comprising:

one or more exit ports in the stuffing box housing; and a line interconnecting an exit port with a detector, such that leakage of fluid from the stuffing box may be detected.

7. A stuffing box as defined in claim 1, further comprising:

a fluid passageway in the housing to supply lubricant to the one or more bearings.

8. A stuffing box for sealing with rotating a rod string extending into a well for powering a pump, comprising:

a stuffing box housing having a lower open end and an upper open end;

a sleeve rotatable within the stuffing box housing by a drive shaft and having an elongate cavity for receiving a portion of the rod string;

one or more bearings for guiding rotation of the sleeve with respect to the housing;

a plurality of static seals each sealing between the sleeve and the rod string;

a plurality of dynamic fluid pressure energized seals each energized by well pressure surrounding the rod string for sealing between the sleeve and the stuffing box housing;

an outer sleeve supported on the rod string for sealing engagement with the plurality of dynamic seals;

the sleeve including a top cap portion axially movable with respect to a lower sleeve portion; and an axially compressive member activated by movement of the top cap portion with respect to the lower sleeve portion to compress each of the plurality of static seals for reliable sealing engagement with the rod string.

9. A stuffing box as defined in claim 8, wherein the stuffing box housing includes a lower flange for interconnection with a wellhead, and an upper flange for interconnection with a powered drive outputting the drive shaft.

10. A stuffing box as defined in claim 8, further comprising:

another dynamic seal positioned above the one or more bearings for sealing between the housing and the sleeve to retain fluid which may leak past the one or more dynamic seals.

11. A stuffing box as defined in claim 8, further comprising:

a spring for biasing each of the dynamic seals toward engagement with both the sleeve and the housing.

12. A stuffing box for sealing with a rotating a rod string extending into a well for powering a pump, comprising:

a stuffing box housing having a lower open end and an upper open end each for receiving the rod string therein, the stuffing box housing including a lower flange for interconnection with a wellhead, and an upper flange for interconnection with a powered drive outputting the drive shaft;

a sleeve rotatable within the stuffing box housing by the drive shaft and having an elongated cavity for receiving a portion of the rod string;

one or more bearings for guiding rotation of the sleeve with respect to the stuffing box housing;

a plurality of static seals each sealing between the sleeve and the rod string;

a plurality of dynamic fluid pressure energized seals each sealing between the sleeve and the stuffing box housing;

a biasing member to compress each of the plurality of static seals for reliable sealing engagement with the rod string;

one or more exit ports in the stuffing box housing; and a line interconnecting an exit port with a detector, such that leakage of fluid from the stuffing box may be detected.

13. A stuffing box as defined in claim 12, further comprising:

the sleeve including a top cap portion axially movable with respect to a lower sleeve portion to activate the biasing member.

14. A stuffing box as defined in claim 13, wherein the top cap portion of the sleeve is rotationally secured to the drive shaft by a connector.

15. A stuffing box as defined in claim 12, further comprising:

a spring for biasing each of the dynamic seals toward engagement with both the sleeve and the housing.

16. A stuffing box as defined in claim 12, wherein well pressure surrounding the rod string energizes the plurality of dynamic seals.

17. A stuffing box as defined in claim 12, further comprising:

another dynamic seal positioned above the one or more bearings for sealing between the housing and the sleeve to retain fluid which may leak past the one or more dynamic seals.

* * * * *